United States Patent [19]

Chesseri et al.

[11] 4,090,934

[45] May 23, 1978

[54] GOLD PLATING WITH ELECTROCHEMICAL PASSIVATION

[75] Inventors: Roy Joseph Chesseri, North Plainfield; Yutaka Okinaka, Madison, both of N.J.

[73] Assignee: Bell Telephone Laboratories, Incorporated, Murray Hill, N.J.

[21] Appl. No.: 817,903

[22] Filed: Jul. 22, 1977

[51] Int. Cl.[2] ..... C25D 11/34

[52] U.S. Cl. ..... 204/140

[58] Field of Search ..... 204/56 R, 140

[56] References Cited

U.S. PATENT DOCUMENTS 3,700,469 10/1969 Okinaka ..... 106/1

OTHER PUBLICATIONS

"Gold Plating Technology", by F. H. Reid, et al., Electrochem. Publications Ltd., 1974, Chapters 3, 5–6.

Modern Electroplating, by F. A. Lowenheim, 3rd Ed., Chapter 8.

*Primary Examiner*—R. L. Andrews

*Attorney, Agent, or Firm*—Walter G. Nilsen

[57] ABSTRACT

A process is described for making gold platings of low effective porosity. This process involves first putting down a gold layer on a surface and then passivating the surface using an electrochemical procedure. This process permits use of much thinner gold layers than ordinarily used without the danger of corrosion of underlying base metal.

8 Claims, 2 Drawing Figures

GOLD PLATING WITH ELECTROCHEMICAL PASSIVATION

BACKGROUND OF THE INVENTION

1. Field of the Invention

The invention relates to a process for producing modified gold layers.

2. Description of the Prior Art

Gold layers are extensively used for many industrial applications including production of jewelry, other ornamental articles, optical devices as well as in the fabrication of electronic circuits and components.

In recent years the use of gold in such industrial applications has been increasing very rapidly. Gold platings are very attractive and extensively used for decorative purposes particularly in the jewelry industry. Gold platings are extensively used in the manufacture of electronic devices and components due to their good electrical properties and electrical contact properties as well as its freedom from corrosion. Because of extensive and increasing use and the high cost of gold it is highly desirable to minimize the amount of gold used in various articles and devices without substantially detracting from article appearance, device performance and useful life and reliability.

For example, in many applications both for decorative purposes and in electrical devices, minimum gold layer thicknesses are dictated by anti-corrosion requirements rather than appearance or electronic requirements. Thus, it is highly desirable to develop a procedure for limiting the effects of porosity of gold layers so that less gold might be used without diminishing life expectancy and reliability. Such reduction in gold usage is highly desirable economically.

SUMMARY OF THE INVENTION

The invention is a procedure for producing protective layers on base metals in which the protective layer is made largely of gold and the surface is treated with an anodic electrolytic procedure. This procedure results in a gold layer of low effective porosity. It is particularly useful for base or surface metals such as nickle. Generally, the process is useful for various nickel alloys as well as nickel metal (at least 95 percent nickel). Particularly useful is plated nickel (e.g., electrolytic nickel, etc.) used in a variety of devices including electronic circuits. The procedure involves subjecting the surface including gold layer to an anodic passivating procedure. The anodic passivation procedure may be carried out in any alkaline aqueous solution but generally solutions of alkali-metal bases are preferred because of convenience, higher solubility and higher hydroxyl-ion concentration. Although the procedure is useful over wide concentration ranges, a range from 0.1 molar to saturation is preferred because passivation can be done in a reasonably short time. Concentrations of one molar or even four molar yield even better results in terms of protective capacity of the passivating layer against corrosion in a corrosive atmosphere and reduced time required to obtain passivation. Often, concentration is limited by convenience to 1–2 molar because of the caustic nature of the solution. Although room temperature is preferred for convenience, any temperature between the freezing temperature and boiling temperature of the solution may be used. Also, improved results are obtained in terms of rapidity of passivation and extent of passivation as temperature is increased. Because of the corrosive nature of the solution, a temperature in the range between 50° and 75° C is preferred for convenience. This procedure leads to a gold film which despite small thicknesses has low effective porosity which will not corrode even after extended use. This procedure leads to articles and devices with expected long life despite minimum use of gold.

DETAILED DESCRIPTION

1. THE GOLD LAYER

Figure 1:
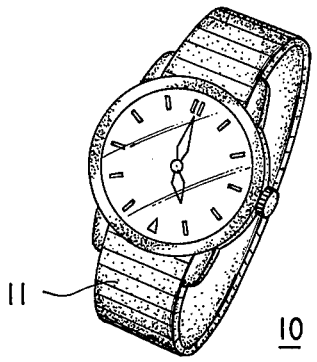
FIG. 1 is a top view of a piece of jewelry with a modified gold layer made in accordance with the invention.

The gold layer may be produced by a variety of methods including electroplating, electroless plating, vacuum deposition, etc. Gold electrodeposition is well known and is described in a variety of references including "Gold Plating Technology" by F. H. Reid and W. Goldie, *Electrochemical Publications Limited,* 1974, and *Modern Electroplating* edited by F. A. Lowenheim, 3rd edition, Wiley, New York, 1963.

Some typical compositions for electroplating solutions are given below. These electroplating procedures may be carried out at various temperatures between the freezing point and boiling point of the solution. Preferred temperatures are given for some examples.

| | | |
|---|---|---|
| 1. | Hard Gold | |
| | Potassium gold cyanide $KAu(CN)_2$ | 12–46 gm/l |
| | Citric acid anhydrous | 80–120 gm/l |
| | KOH | 4–6 gm/l |
| | Cobalt citrate | 100–200 ppm |
| 2. | Hard Gold | |
| | Potassium gold cyanide | 12–46 gm/l |
| | Phosphoric acid to adjust pH to approximately 4.2 | |
| | Cobalt citrate | 100–200 ppm |
| 3. | Soft Gold | |
| | Potassium gold cyanide | 12–46 gm/l |
| | Potassium hydrogen phosphate | 40 gm/l |
| | Potassium dihydrogen phosphate | 10 gm/l |
| | This yields a solution with pH approximately 7.0 and plating should be carried out at a temperature of approximately 65 degrees C. | |
| 4. | Soft Gold | |
| | Potassium gold cyanide | 20 gm/l |
| | $(NH_4)_2HC_6H_5O_7$ | |
| | pH 5 – 6.5 plating temperature approximately 65 degrees C. | |

Electroless gold deposition may also be used to produce the gold layer. Included in such electroless deposition are gold displacement procedures as well as catalytic plating procedures and truely autocatalytic gold plating procedures. Many such procedures have been described in Chapter 11 of the Reid and Goldie reference cited above. Other electroless gold plating procedures and bath composition are described in U.S. Pat. No. 3,700,469 issued on Oct. 24, 2972 to Yutaka Okinaka.

Another procedure for producing gold films is vacuum evaporation of gold. These procedures are also well known and have been described extensively in the literature. Inlay gold may also be used to provide the gold layer. This method uses a gold sheet or ribbon, often very thin, which is bonded to an undersurface, usually of metal.

The nature of the gold layer may vary considerably. Various alloys may be used including hard gold (for example, hardened with Co, Ni, etc.) but generally at least 60 percent by weight should be gold. Generally the process is most useful for porous gold layers. Many gold layers, particularly those made from plating solutions have at least 95 percent or even 99 percent by weight gold.

In some cases, the procedure is most beneficial when the gold layer is quite thin, for example, less than 500 microinches or in some cases even less than 150 microinches. The reason for this is that porosity increases dramatically with reduced thickness. In the range from 50 to 150 microinches careful plating often reduces porosity but under manufacturing conditions, porosity is often a problem. Below 50 microinches, porosity is almost always a problem and often a severe problem. For some electroless plating and displacement plating procedures which produce platings in the 1–10 microinch and below one microinch respectively, the porosity problem is almost always severe.

2. THE PASSIVATION PROCEDURE

Surfaces with porous gold layers are rendered passive to corrosion by an electrolytic passivation procedure. The gold layered surface is biased anodically and the surface anodized electrolytically. Neither time nor current density are critical provided a certain minimum current and amounts of time are used to insure complete passivation. The minimum current is 0.1 ma/cm$^2$ and minimum amount of time is 1 minute, but the preferred minimums are 0.1 ma/cm$^2$ and 5 minutes. This preferred minimum current and time insures good passivation of the gold layer even under fairly extreme corrosion conditions. Maximum amounts of time are generally set by convenience rather than properties of the gold film. Generally, the properties of the gold film improve with increased time of treatment. However, beyond about 15 minutes at 1 ma/cm$^2$ or about 30 minutes at 0.1 ma/cm$^2$, the improvement is rather small. Maximum current density is about 10 ma/cm$^2$. Higher current densities may be used but there is some danger of affecting the gold layer or the base metal. Also, no advantages seem to accrue from use of higher current densities. Actually, a maximum current density of 1 ma/cm$^2$ is preferred because of convenience (size of equipment, etc.) and excellent results obtained.

Best results are obtained in an alkaline aqueous solution. Any alkaline aqueous solution (that is, with pH greater than 7) yields satisfactory results, but good results are obtained with a concentration greater than 0.1 molar hydroxide ion. Various sources of hydroxyl ion may be used (ammonia for example) but alkali-metal hydroxidès are preferred because of ease of availability, high solubility and high hydroxide-ion concentration obtained. Exceptionally good results are obtained with 1–2 molar alkali-metal hydroxide and best results with 4 molar alkali-metal hydroxide. Any alkali-metal hydroxide may be used including lithium hydroxide, sodium hydroxide and potassium hydroxide. Sodium hydroxide and potassium hydroxide are preferred principally because of easy availability. Although current may be varied during the anodic oxidation procedure, generally it is preferred to have relatively constant current. Typically, current conditions are 0.1 ma/cm$^2$ (within approximately ±25%) for a period of 15 minutes. Current pulses and extremely high currents for short periods of time may also be used. Solution agitation is often beneficial, and sometimes movement of the surface being passivated relative to the passivation solution is convenient and improves results. Typical, is the rotation of the surface being passivated in the passivation solution.

3. POROSITY TESTS

The beneficial advantages of the inventive procedure are best demonstrated through porosity tests on the treated gold layers. The porosity test used is called the electrographic porosity test. This method involves use of an electrolytic indicator solution containing approximately 20 grams/liter of the disodium salt of dimethylglyoxime and 20 grams/liter of sodium chloride. Deionized water is generally used in making up this solution. A dye transfer paper (for example, type-F double weight dye transfer paper available from Eastman Kodak Company) is also used. The dye transfer paper is shaped to fit on the surface being tested and then soaked in the electrolyte indicator solution for between 15 and 45 minutes. The surface being tested is cleaned (generally with an organic solvent) and then the soaked dye transfer paper is placed against the surface being tested. A cathode is then added and the assembly pressed together. The surface being tested is biased anodically with approximately 2 volts. The current is typically between 1 and 10 milliamps. The voltage is usually applied for approximately 60 seconds. Porosity is indicated by the number of spots (generally red for nickel base metal and green for copper base metal).

4. EXAMPLES

A nickel surface with approximately 20 microinches of electroplated gold is subjected to the procedure by biasing it anodically and passing approximately 1 milliamp/cm$^2$ of current through the surface for 10 minutes. The electrolytic solution is 1 molar aqueous sodium hydroxide and this solution is maintained at approximately 50 degrees. For comparison a portion of this surface was not subjected to the procedure. Both surfaces are subjected to a porosity test as described above. The results show an extensive reduction in porosity as indicated by a drastic reduction in the density and size of the spots. Indeed the treated surface shows little or no porosity at all.

5. THE FIGURES

FIG. 1 shows an article of jewelry 10 in particular a watch 11. This piece of jewelry is gold plated and treated in accordance with the invention.

Figure 2:
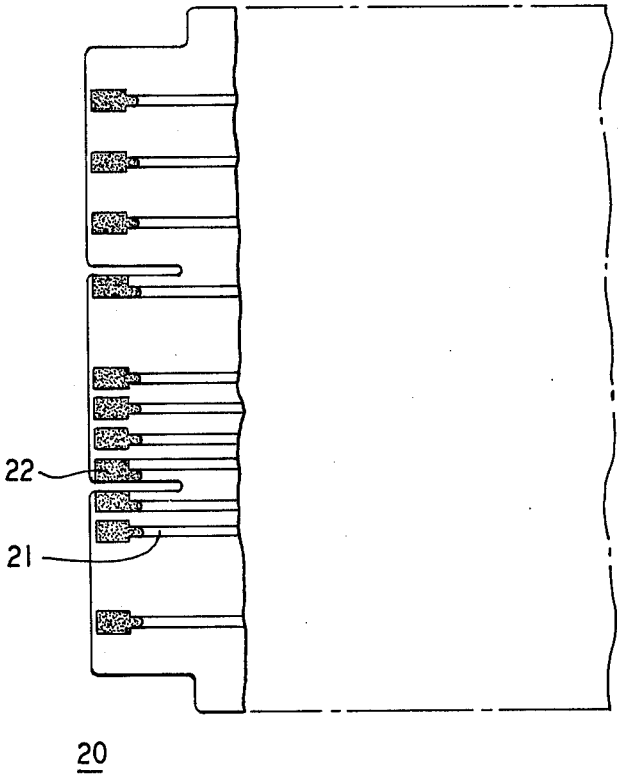
FIG. 2 is a top view of a circuit board showing contact fingers with modified gold plating made in accordance with the invention.

FIG. 2 shows an electronic circuit 20 with various circuit elements 21 and a series of contact fingers 22 which are gold plated for improved contact conductance. These gold plated fingers have particularly thin gold platings which are sufficient in thickness for low contact resistance and have been treated in accordance with the invention to insure corrosion protection over long periods of time.

What is claimed is:

1. A process for producing an article with at least one passivated layer said layer consisting of at least 90 percent by weight of gold on a metallic surface consisting of at least 95 percent by weight of nickel said process comprising the step of passing current through an anode and aqueous solution and a cathode with both cathode and anode at least partially immersed in the aqueous solution and in which the anode includes the metallic surface with the layer characterized in that the aqueous solution consists essentially of an aqueous solution of alkali-metal hydroxide with a pH greater than 7 so as to decrease the effective porosity of the layer as evidenced by decreased number of spots in an electrographic porosity test using dimethylglyoxime as the indicator.

2. The process of claim 1 in which the aqueous solution contains at least 0.1 molar alkali-metal hydroxide.

3. The process of claim 2 in which the aqueous solution contains at least 1–2 molar alkali-metal hydroxide.

4. The process of claim 3 in which the aqueous solution contains at least 4 molar alkali-metal hydroxide.

5. The process of claim 1 in which the alkali-metal hydroxide is selected from the group consisting of sodium hydroxide and potassium hydroxide.

6. The process of claim 1 in which the metallic surface consists essentially of nickel produced by an electrolytic process.

7. The process of claim 1 in which the aqueous solution is maintained between 50° and 75° C.

8. The process of claim 1 in which the anodizing current is between 0.1 milliamps/$cm^2$ and 10 milliamps/$cm^2$.

* * * * *